United States Patent [19]

Fetcko

[11] Patent Number: 4,872,816

[45] Date of Patent: Oct. 10, 1989

[54] EVACUATION PUMP ASSEMBLY

[75] Inventor: Michael Fetcko, Habron, Ind.

[73] Assignee: The Aro Corporation, Bryan, Ohio

[21] Appl. No.: 263,688

[22] Filed: Oct. 28, 1988

[51] Int. Cl.[4] ..... F04B 55/00

[52] U.S. Cl. ..... 417/360; 417/234; 417/393; 141/98; 248/215

[58] Field of Search ..... 417/234, 360, 393, 313, 417/572; 138/106, DIG. 11; 141/98, 382; 4/509; 248/213, 215, 339; 222/383, 372, 180; 220/86 R; 184/1.5; 137/356

[56] References Cited

U.S. PATENT DOCUMENTS 3,216,650 11/1965 Thyreen ..... 417/234

4,193,143 3/1980 De Carvalho Vianna ..... 4/509 X

*Primary Examiner*—Carlton R. Croyle

*Assistant Examiner*—Robert N. Blackmon

*Attorney, Agent, or Firm*—Allegretti & Witcoff, Ltd.

[57] ABSTRACT

A diaphragm pump is mounted on a frame or bracket. The inlet of the diaphragm pump connects with a flexible hose or tubing having a probe designed to fit into a vehicle fluid passage such as the dip stick passage associated with the oil pan of a vehicle. The outlet to the diaphragm pump is connected to one of a pair of based hollow tube members designing part of a bracket for support of the pump. Each hollow tube has a generally S shape configuration and is connected to the other tube by cross braces. One of the hollow tubes has the dual function of acting as a support bracket for the diaphragm pump assembly and as a fluid conduit, which is connected to the diaphragm pump outlet at one end and defines a discharge passage into a container at the opposite end. The bracket assembly may thus be supported on a drum or other container by the bracket members with one of the bracket members serving as the discharge tube into the container.

4 Claims, 2 Drawing Sheets

EVACUATION PUMP ASSEMBLY

BACKGROUND OF THE INVENTION

This invention relates to pump assembly for removing fluid from reservoirs through an elongated tube which projects into the reservoir, and, more particularly, to a pump assembly designed to remove fluids such as oil from the oil pan of a vehicle with minimum spillage and in a manner which prevents vaporization or fluid loss.

Heretofore there are many circumstances in which it is necessary to periodically remove a fluid such as a lubricating fluid from a reservoir. This is most often encountered in vehicle servicing. However, there are other circumstances where fluids may normally be retained in a reservoir or tank, and it is necessary to pump or remove the fluid from that reservoir or tank for one purpose or another. When such removal is undertaken in vehicles, typically a drain plug is provided in the bottom of the tank or reservoir in the vehicle, and that drain plug is removed so that the fluid may be collected in a pan or container.

With the advent of high speed custom service stations designed to replace vehicle fluids in a speedy fashion, the time required to elevate a vehicle or otherwise position a vehicle to remove drain plugs from oil pans or other reservoirs has led to undesirable delays in the servicing of vehicles. More over such vehicle serving equipment is expensive. Thus there has developed a need for an improved and more efficient manner of removing such fluids from reservoirs. This need persists not only with respect to servicing of automobiles, but also in other fields. For example, one may desire to remove liquid fertilizer from a large storage tank for placement into smaller dispensing tanks. There are numerous other circumstances wherein removal of fluid from one container and placement in another container is desired.

It is against this background of need that the present invention has been developed

SUMMARY OF THE INVENTION

Briefly the present invention comprises an improved portable pump assembly for evacuation of fluids from a reservoir for discharge into a separate container. The portable pump assembly comprises, a pump which has an inlet manifold, with an inlet thereto and an outlet manifold having an outlet therefrom The pump is mounted on a bracket which supports the entire assembly on the container into which the fluid is being pumped.

In a preferred embodiment the bracket is comprised of a pair of generally identical S shaped tubes which are connected to one another by means of cross brace members The pump is attached to the cross brace members. In the preferred embodiment a diaphragm pump is used to thereby effect sufficient transfer of a wide range of fluid without direct contact of the fluid to any operator. The inlet to the pump is connected by means of a flexible hose and appropriate tubing to the reservoir which is to be evacuated. The outlet from the pump connects to one end of one of the tubes. The other end of a tube defines a hook which fits over the container that supports the assembly. The S shape tube thus serves the dual function of supporting the assembly and providing a conduit for directing fluid from the pump into the container.

Thus it is an object of the invention to provide an improved pump assembly for removing fluids from a reservoir and directing them into a container.

It is a further object of the invention to provide an improved pump assembly, wherein, a pump is supported on a bracket comprised of at least one tubular member, that tubular member also serving as part of the fluid flow pathway from the reservoir to the container Yet another object of the invention is to provide an inexpensive and portable pump assembly which can be utilized for removing fluids from generally inaccessible reservoirs to a separate container.

These and other object advantages and features of the invention will be set forth in the detailed description which follows.

BRIEF DESCRIPTION OF DRAWING

In the detailed description which follows, reference will be made to the drawing comprised of the following figures.

DESCRIPTION OF THE PREFERRED EMBODIMENT

Figure 1:
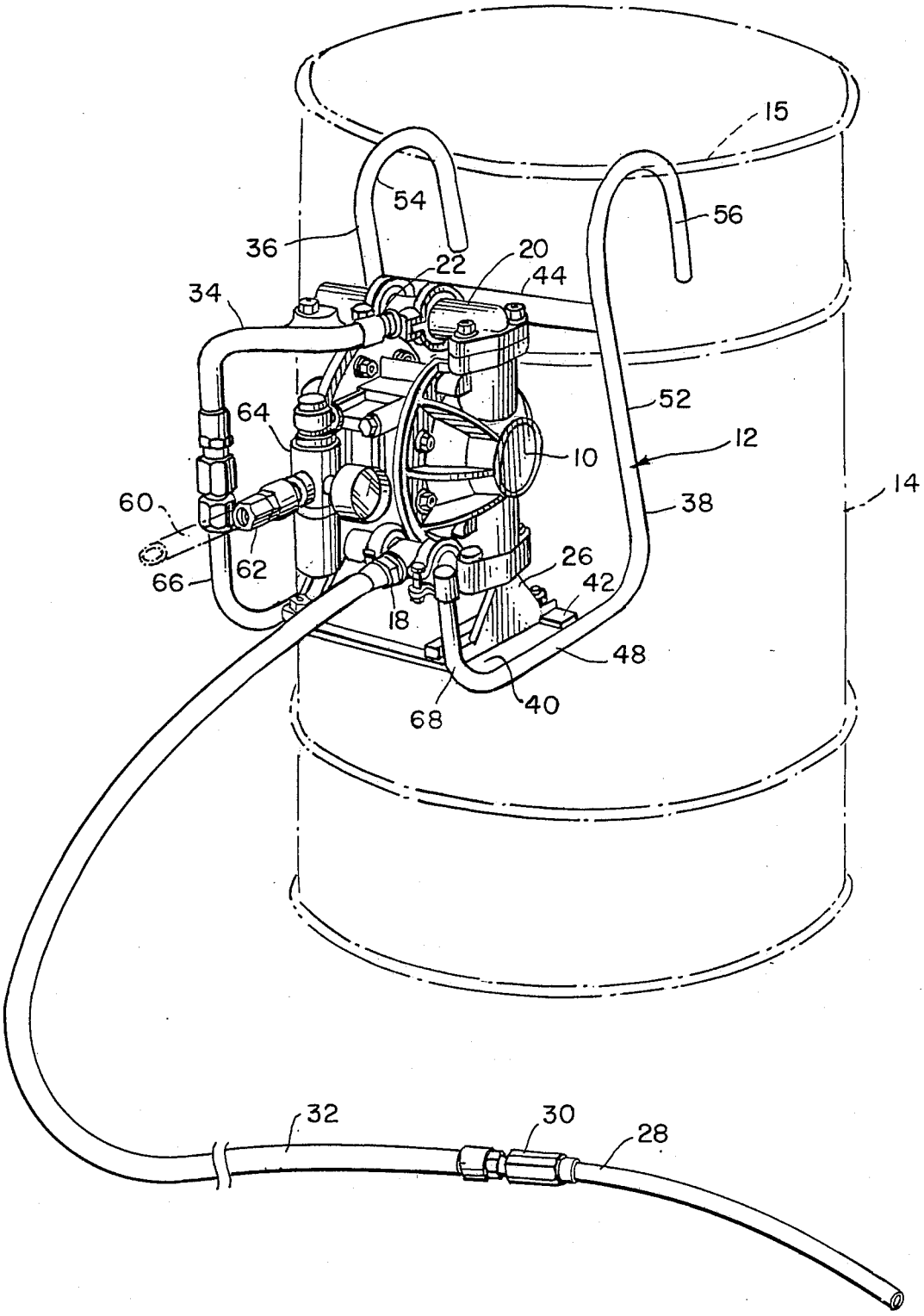
FIG. 1 is a prospective view of the improved assembly of the present invention.

FIG. 1 is a prospective view illustrating the construction of the pump assembly of the invention. The assembly is comprised of a pump 10, which is supported by a bracket 12. The bracket 12 is designed so as to support the assembly on a container such as a tank 14 with an extension of the bracket 12 hanging over the edge or lip 15 of the container 14 so as to support the assembly. The container 14 may comprise, for example, a 55 gallon drum.

Figure 2:
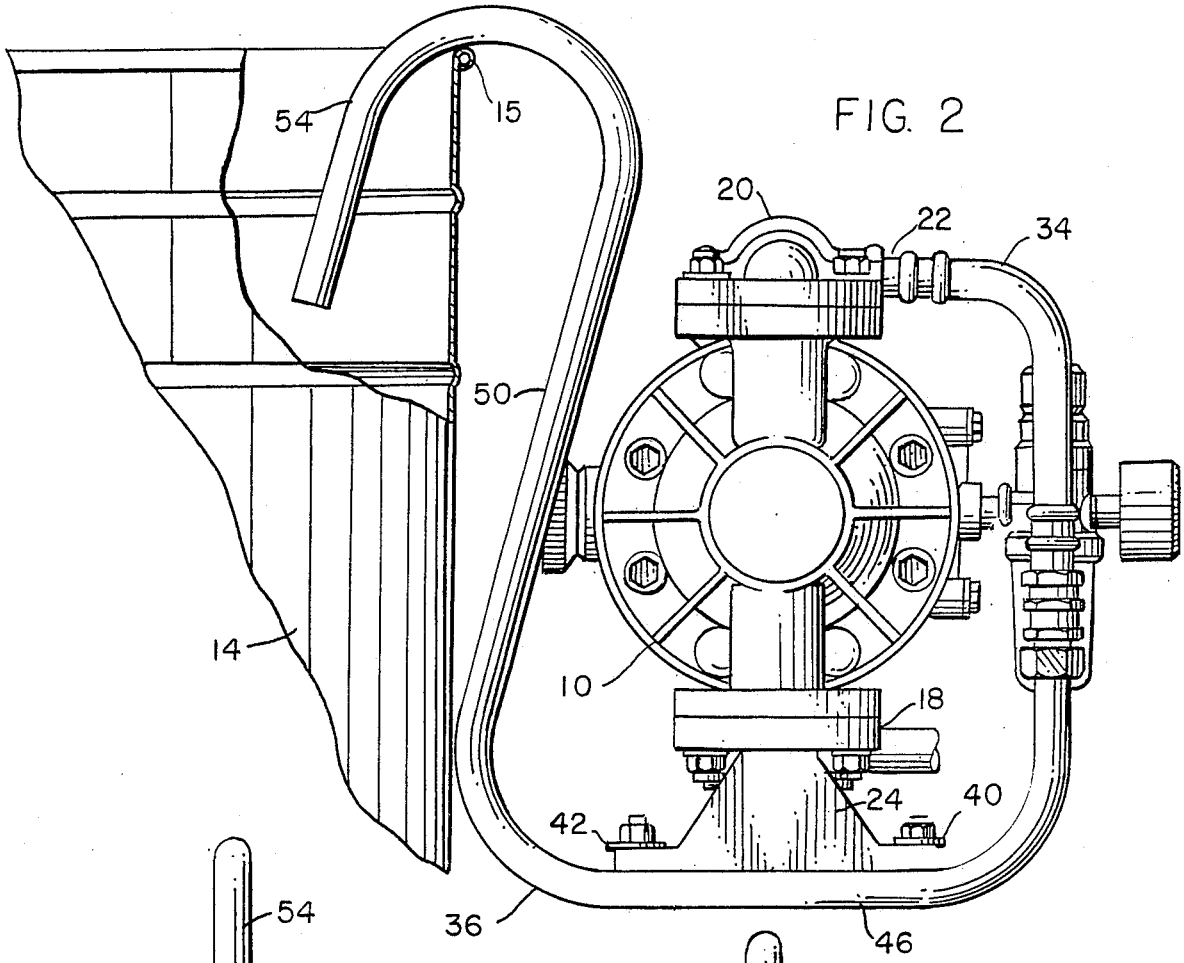
FIG. 2 is a side elevation of the improved pump assembly of the invention.
Figure 3:
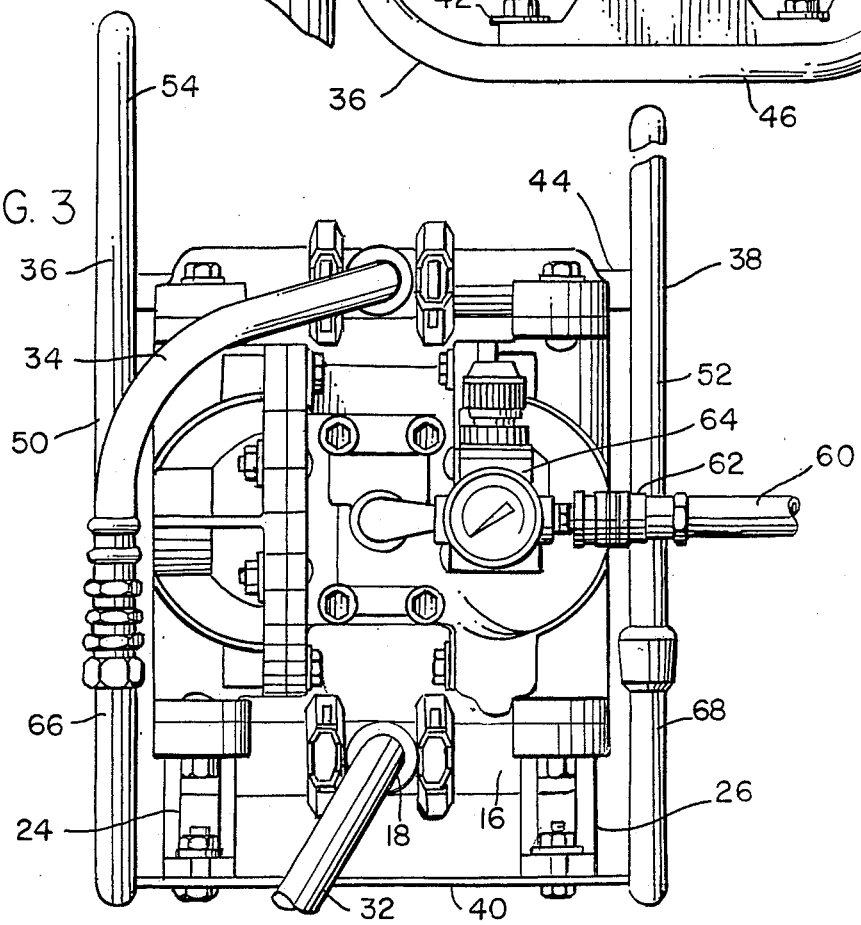
FIG. 3 is a front elevation of the improved pump assembly of the present invention

FIGS. 2 and 3 are elevation views of the assembly shown in FIG. 1. Referring to the figures, therefore, the pump 10 is typically preferably a ½" inch double diaphragm pump which is operated by pneumatic pressure. Typical of a pump which is useful with the construction of the present invention is ARO ½" inch diaphragm pump Model No. 666053-311, made by The Aro Corporation, Bryan, Ohio, U.S.A. This is an air driven double diaphragm pump having an inlet manifold 16 with an inlet 18. Fluid entering the inlet 18 is pumped by the internal pump mechanism and exits through outlet manifold 20 and, more particularly, through the outlet 22. The inlet manifold 16 is attached to first and second legs 24 and 26 which support the pump 10 on bracket 12.

A rigid elongated tube 28 connects by means of a connector 30 with a flexible hose 32 that is, in turn, connected to the inlet 18. The tubing 28 defines a probe which may be inserted into a reservoir (not shown) from which the fluid is to be withdrawn.

The outlet 22 from pump 10 connects with a flexible discharge hose 34. The bracket 12 for supporting the assembly is comprised of first and second generally S shaped hollow steel tube members 36 and 38 which have substantially the same configuration and which are interconnected to one another by three cross brace members 40, 42, and 44. The brace members 40, 42 and 44 are flat steel plates which interconnect the hollow tube members 36 and 38. The brace members 40, 42 and 44 are of identical size and shape and length so as to uniformly space the tube members 36 and 38 from one another. Two of the brace members 40 and 42 define a generally horizontal platform for attachment of the legs 24 and 26. The brace members 40 and 42 thus connect with generally runs 46 and 48 of the tube members 36 and 38 respectively. The horizontal runs 46 and 48 are connected respectively to generally vertical runs 50 and 52 respectively which extend for the full height of the pump 10 and terminate with curved or looped ends 54 and 56 respectively which are designed to fit over the edge or lip 16 of the container 14.

Each tube member 36 and 38 is hollow. A fluid connector 58 is attached to one end of the leg or tube member 36. The connector 58 is connected with the flexible discharge hose 34. Fluid which is discharged from the outlet 22 thus flows through the hose 34, the connector 58, the tube member 36 and then from the end 36 into the container 14.

The pump 10 is operated by pneumatic or air pressure which is provided through a pneumatic source such as pneumatic hose 60 which connects by means of a pneumatic connector 62 through a regulator and pressure gauge 64 to the pump 10. Note that the forward ends 66 and 68 of the tube members 36 and 38 extend forward of the pump 10 and are turned upwardly to define short vertical runs generally parallel to the runs 50 and 52. The pump 10 is thus cradled between runs 50 and 52 and ends or runs 66 and 68. This protects the pump 10 and also protects users of the pump from access to operation of the pump. This provides a safety feature associated with the construction.

In operation the tube 28 is inserted through an opening into a reservoir or tank. The pump is operated to withdraw fluid through the tube 28 and hose 32 into the pump 10. The fluid is then discharged by the pump 10 through the hose 34, tube member 36 and ultimately into the container 14. The tube member 36 thus serves a dual function of supporting the assembly as well as providing a conduit for fluid pumped by the assembly.

It is possible to provide variations with the respect to the construction. The configuration of the tube members 36 and 38 may be varied. Of course it is necessary to only have one of those members 36 or 38 as a hollow fluid flow member although both may serve such function. In fact, it is only necessary to use a single member 36 or 38 to support the pump assembly. Nonetheless, the preferred embodiment is as depicted. Various pumps other than a diaphragm pump may be utilized with the construction of the invention. The invention, therefore, to be limited only by the following claims or their equivalents.

What is claimed is:

1. An improved portable pump assembly for evacuation of fluid from a reservoir for discharge into a container, said assembly comprising, in combination:
   - a pump having an inlet manifold with an inlet and a outlet manifold with an outlet; and
   - a bracket for supporting the assembly on a container, said bracket including;
   - a support platform for the pump; and
   - a first hollow tube attached to the platform, said tube defining at one end thereof a support hook for supporting the platform on the container and including a fluid inlet connector at the opposite end, said outlet of the pump being attached to the inlet connector to thereby direct pumped fluid through the tube for discharge from the support hook end into the container, the inlet to the inlet manifold being attached to a fluid inlet conduit.

2. The improved pump assembly of claim 1 wherein the bracket comprises first and second identically shaped tubes each defining a support hook and each attached to the support platform generally on opposite sides of the pump.

3. The improved pump assembly of claim 1 wherein the pump comprises a double diaphragm pump mounted on the platform.

4. The improvement of claim 1 wherein the bracket comprises first and second, substantially shaped tubes formed with an S configuration to define a hook at one end and a part of a platform at the opposite end, and wherein the platform further comprises cross members connecting the tubes and separating the tubes, said pump being attached to and supported by the cross members.

* * * * *